US006581765B1

(12) United States Patent
Rhyne

(10) Patent No.: US 6,581,765 B1
(45) Date of Patent: Jun. 24, 2003

(54) HANGER DISPLAY PACKAGE

(76) Inventor: Steven B. Rhyne, P.O. Box 3718, Chattanooga, TN (US) 37404

( * ) Notice: Subject to any disclaimer, the term of this patent is extended or adjusted under 35 U.S.C. 154(b) by 18 days.

(21) Appl. No.: 10/021,452

(22) Filed: Oct. 29, 2001

(51) Int. Cl.[7] ..... B65D 5/42
(52) U.S. Cl. ..... 206/284; 206/296; 206/297
(58) Field of Search ..... 206/278, 279, 206/282, 283, 284, 285, 292, 296, 297, 298, 299, 806

(56) References Cited

U.S. PATENT DOCUMENTS 2,656,914 A * 10/1953 Gordon ..... 206/280
4,601,417 A * 7/1986 Kunreuther ..... 223/85
5,027,945 A * 7/1991 Wilkins ..... 206/278
6,508,357 B1 * 1/2003 Faircloth et al. ..... 206/284

* cited by examiner

*Primary Examiner*—Jacob K. Ackun
(74) *Attorney, Agent, or Firm*—Alan Ruderman; Stephen J. Stark; Miller & Martin LLP

(57) ABSTRACT

A hanger supports the weight of merchandise on a merchandise support arm. The hanger proceeds through an opening in a sleeve into a cavity where the merchandise is supported by a merchandise support arm. The hanger arm includes a fixture attachment, such as a hook for cooperation with a display fixture. The sleeve assists in retaining the merchandise on the hanger when inserted properly. Furthermore, a sleeve has at least one display panel which may be utilized to provide information relating to the product. It is further anticipated that some embodiments of hangers may include retention means to assist in retaining the hanger relative to the sleeve and/or merchandise support arm on the support arm.

19 Claims, 5 Drawing Sheets

HANGER DISPLAY PACKAGE

DESCRIPTION OF RELATED ART

1. Field of the Invention

This application is directed to an apparatus for packaging merchandise and more specifically to an apparatus for supporting merchandise, such as apparel, from a hanger while providing surfaces for displaying product information on a sleeve.

2. Description of Related Art

Shelf space is very important to many retailers. One technique of maximizing shelf space is to support merchandise from hangers with the hangers supported by display fixtures including pegs, posts or the like extending from a pegboard.

There are at least two common techniques of providing apparel products such as socks, hosiery, etc., for display from a display fixture at a retail location. In Rhyne, U.S. Pat. No. 4,590,618, there is disclosed a plastic bag enclosure which is equipped with a hanger hook for support by a peg at a retail location. This packaging product is particularly well adapted for supporting multiple pairs of socks or other groupings of products. The merchandise may be viewed through at least portions of the plastic bag, while allowing the retailer the opportunity to provide a large quantity of merchandise in a relatively small amount of retail space.

Another prior art technique for displaying hosiery includes folding the product and placing a band about the folded product. A plastic hanger is then inserted between the fold and the band to support the product at the fold. The hanger has a hook adapted to cooperate with a peg. The band typically has adhesive on one side for retaining the product therein and a label providing product information to the consumer on the other side. Unfortunately, adhesive against the product has been found to cause problems for at least some retailers and manufacturers. Specifically, the adhesive may stick to the product and possibly damage the product when the label is removed. This is especially true with fine mesh fabrics. Alternatively, at least some of the adhesive may stick to the product upon removal of the label and thus require the purchaser to remove the adhesive from the product.

SUMMARY OF THE INVENTION

Accordingly, a need exists and it is an object of the present invention to provide a packaging system for merchandise which does not adhere to the product.

Another object of the present invention is to provide a packaging system which allows a product to hang from a hanger while providing a display area which may be utilized to promote the merchandise.

A further object of the present invention is to provide a hanger system which securely maintains the hanger relative to the product until the packaging is removed by a consumer.

A hanger is utilized to support the weight of the merchandise on a merchandise support arm. In the preferred embodiment, the merchandise is folded at a fold. A paper sleeve is then placed about the folded portion of the merchandise. The paper sleeve has an opening to allow application of the merchandise support arm through the opening and under the fold. The sleeve assists in retaining the merchandise on the hanger when inserted properly. The sleeve preferably has at least one display panel which may be utilized to provide information relative to the product hung from the hanger. In an alternatively preferred embodiment, a "barbed" hanger is utilized which includes retaining arms which may assist in maintaining the product on the hanger while keeping the sleeve in a normal configuration about the merchandise.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
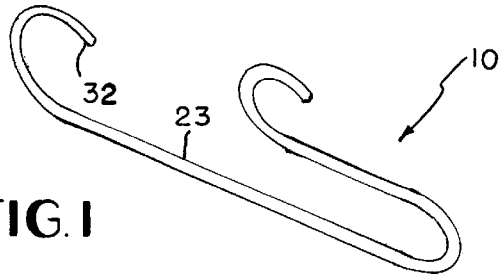
FIG. 1 is a side perspective view of a hanger utilized in a first embodiment of the present invention.
Figure 3:
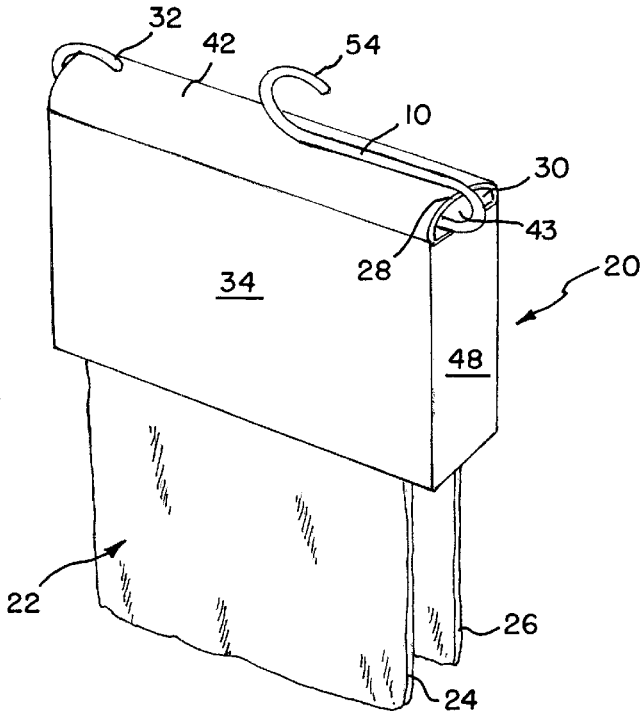
FIG. 3 is a top perspective view of an article of hosiery supported by the first preferred hanger of FIG. 1 and first preferred sleeve of the present embodiment of FIGS. 2A–2D.

The hanger 10 of FIG. 1 is utilized with a sleeve 20 of FIGS. 2A–2D in the first preferred embodiment to support article of merchandise 22, such as an article of hosiery, as illustrated in FIG. 3. The merchandise 22 is preferably folded at least into a first portion 24 and a second portion 26 about a merchandise support, or fold, 28. The fold 28 is placed within the sleeve 20 with the fold 28 is accessible through opening 30. The first end 32 of the hanger 10 is then inserted through the first opening 30 between the first and second portions 24,26, below the fold 28 to support the merchandise 22. The first end 32 of the hanger 10 preferably proceeds out a second opening (obscured from view) and is located as shown in FIG. 3 to assist in retaining the merchandise 22 relative to the sleeve 20 and hanger 10 on the merchandise support arm 23 illustrated in FIG. 1. Other merchandise 22 may not require folding to provide a suitable merchandise support. For instance, two socks may be connected with a plastic fastener having retaining ends on an elongate member support. The elongate member could be utilized as the merchandise support resting atop the merchandise support arm 23 after placing the sleeve about the merchandise 22.

Figure 2B:
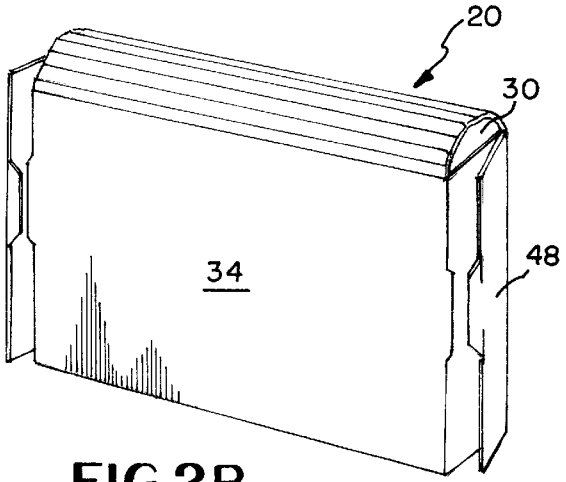
FIG. 2B is a top elevational view of a partially folded first preferred sleeve according to the present invention.
Figure 2C:
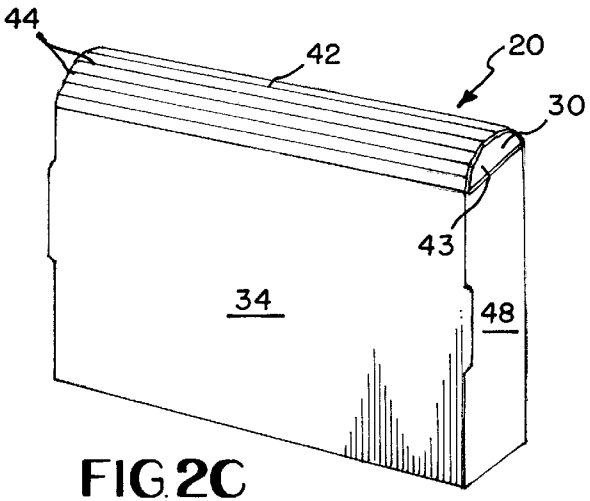
FIG. 2C is a fully constructed first preferred sleeve from a top elevational view.
Figure 2D:
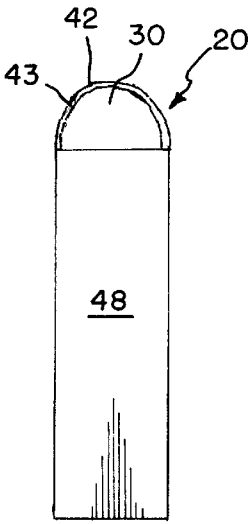
FIG. 2D is a side perspective view of the first preferred sleeve of FIG. 2C.
Figure 2A:
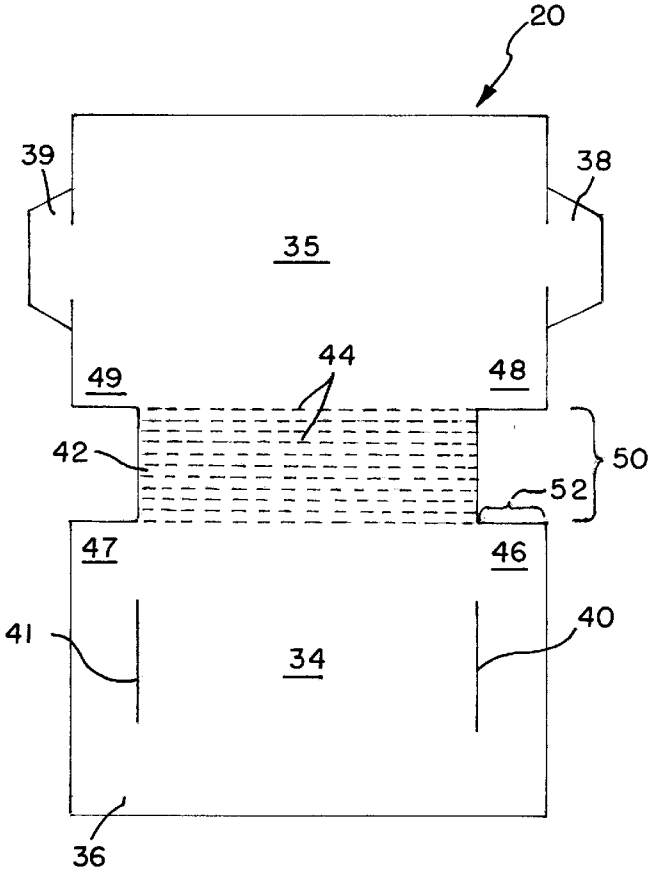
FIG. 2A is a plan view of a sheet blank before folding into a first preferred sleeve showing appropriate cuts.

Although similar hangers such as the embodiment of hanger 10 are believed to be utilized by others, there are no known combination of hangers 10 utilized in conjunction with sleeves 20 to display merchandise 22 wherein the hanger 10 supports the merchandise 22 and retains the sleeve 20 relative to the merchandise 22 as provided herein. Furthermore, there are not believed to be hangers which support a sleeve 22 including a merchandise product 22 therein. The sleeve 20 includes at least one display surface such as the front panel 34 or back panel 35. Returning to FIG. 2A, the sleeve 20 of the preferred embodiment is produced from a cutout, or blank 36, of bendable material, such as paper stock, plastic or other material. The blank 36 is equipped with two arrow tabs 38,39 which are received respectively within a first and second slot 40, 41. The top panel 42 is preferably equipped with a plurality of slits 44 which assist in bending the top panel 42 as illustrated in FIGS. 2B–2D. The illustrated slits 44 are cut in a longitudinal manner. The top panel 42 extends above the merchandise 22.

First and second side panels 46,47 are bent inwardly from the blank 36 as illustrated in FIG. 2B. Third and fourth side panels 48,49 are bent inwardly as illustrated in FIG. 2B as well. The side panels 38-41 are preferably hinged relative to the front or back panels 34,35 respectively at about ninety degrees. Tabs 38,39 are bent at about ninety degrees relative to exterior side panels 48,49 such that the arrow tabs 38,39 15 interface with slots 40,41 as shown in FIG. 2B and provide a cavity 43 within the sleeve 20 when connected as illustrated in FIG. 2C.

Any portion of the surfaces such as exterior side panels 48,49,50,51 front or back panels 34,35 or top panel 42 may be utilized as an information area to display product or other information such as by applying labels, or printing directly thereon or otherwise. The thickness 50 of the top panel 42 is preferably greater than the width 52 of the side panels 46,47,48,49. Accordingly, the first opening 30 of FIGS. 2B–2D and 3 is created when folded as illustrated. The opening 30 allows for the insertion of the hanger 10 to secure the article of merchandise 22 within the sleeve 20 while providing the hanger hook 54 or other fixture attachment for supporting the merchandise from a product display such as a poster peg. A second opening (obscured from view) is typically created opposite the first opening 30. The hanger 10 including the merchandise support arm 23 preferably extends longitudinally through the first opening 30 as illustrated.

Although a first embodiment of a sleeve 20 is illustrated in FIGS. 2A–2D and 3, a second embodiment of a sleeve 60 is illustrated in FIGS. 4A–4D. This embodiment has cutouts 62 in interior and exterior side panels 64,66. When the side panels 64,66 are folded as illustrated in 4B, the resulting opening 68 is created. The opening 68 is different in appearance the opening 30 of the first embodiment of FIGS. 2A–2D, however, both openings 30, 66 allow for the introduction of a first end 32 of hanger 10 to proceed into the cavities 69,43.

Figure 5F:
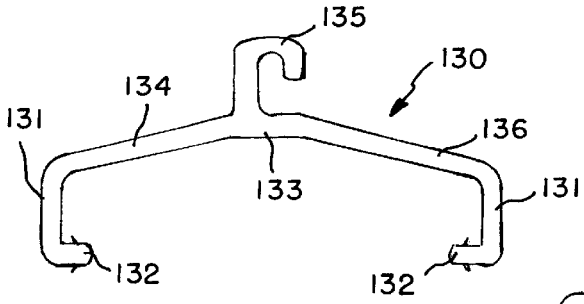
FIG. 5F is a plan view of a fifth embodiment of a hanger.
Figure 5A:
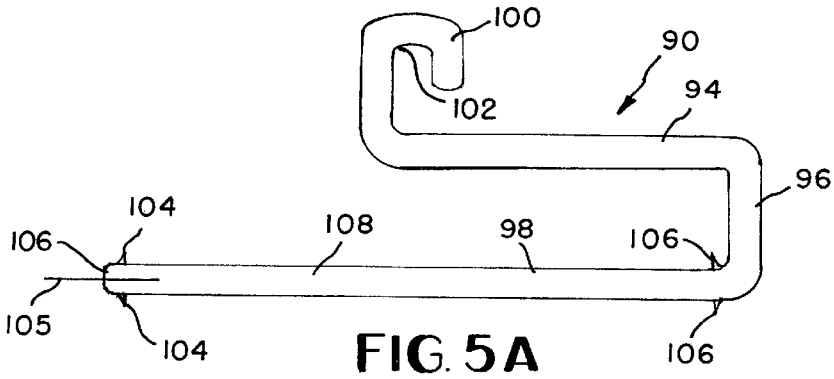
FIG. 5A is a side plan view of a second embodiment of a hanger.
Figure 5B:
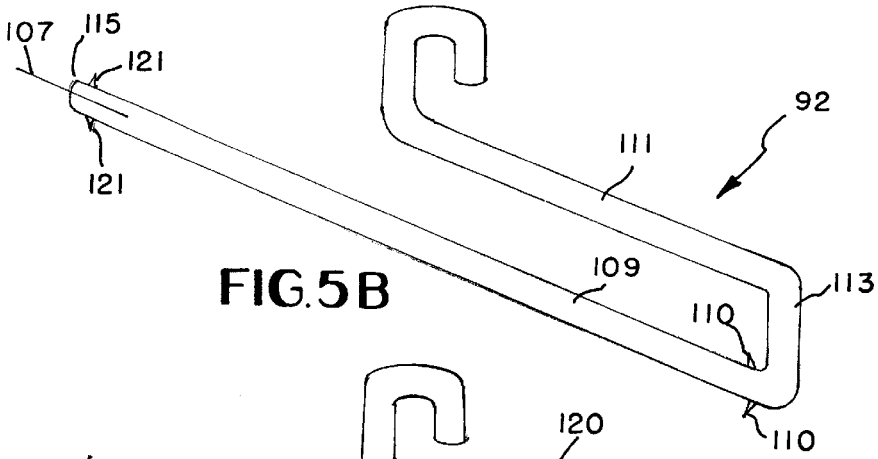
FIG. 5B is a side plan view of a third embodiment of a hanger.
Figure 5D:
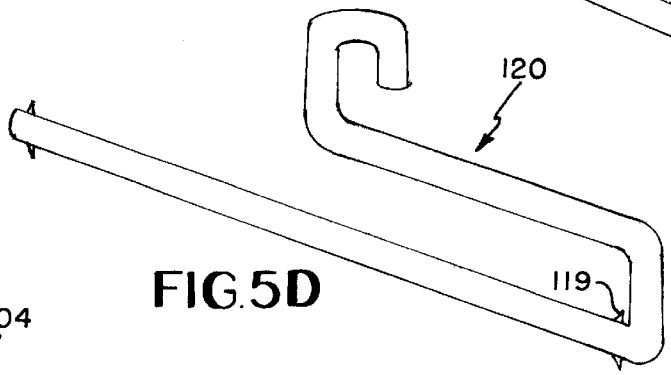
FIG. 5D is a side plan view of a fourth embodiment of a hanger.
Figure 6B:
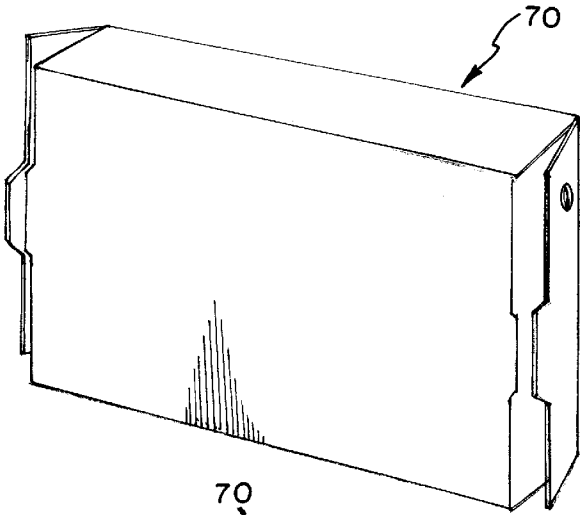
FIG. 6B is a top perspective view of a partially constructed sleeve utilizing the blank of FIG. 6A.
Figure 6C:
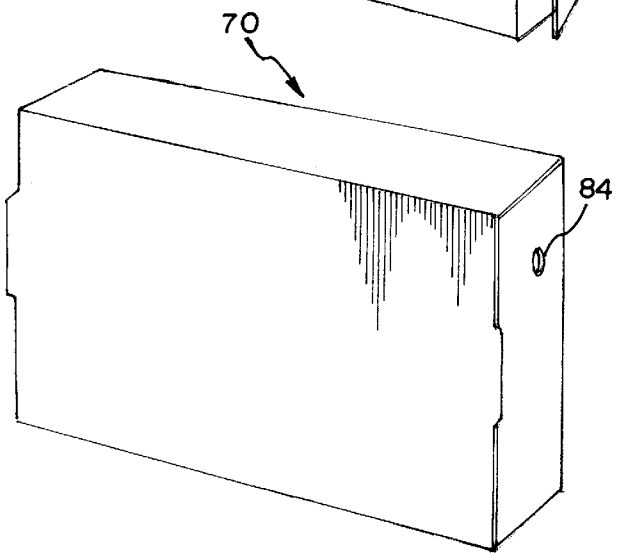
FIG. 6C is a top perspective view of a fully constructed sleeve of a third embodiment.
Figure 6D:
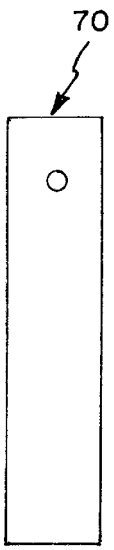
FIG. 6D is an end perspective view of the sleeve of the embodiment of FIG. 6C.
Figure 6A:
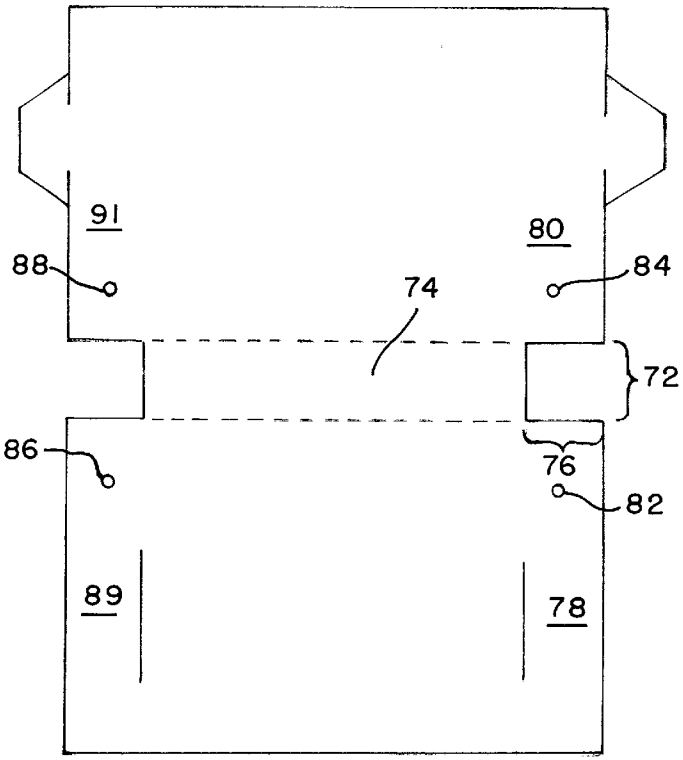
FIG. 6A is a plan view of a sheet blank before folding into a third preferred sleeve embodiment showing appropriate cuts.

The third embodiment of a sleeve 70 is illustrated in FIGS. 6A–6D. In this embodiment, the length 72 of the top panel 74 is substantially similar to the width 76 of the side panels 78,80. Although a hanger 10 could be slid between the top panel 74 and the adjoining side panels 78,80, it is more preferable that first and third openings 82,84 are aligned, thus allowing insertion of an end of a hanger such as either of hangers 90,92 of FIGS. 5A, 5B, 5D or 5F. Other sleeve designs could include a top panel 77 which is angled relative to the sides and/or front and back panels at angles other than ninety degrees as shown in FIGS. 6B–6D. Although openings 82,84,86,88 are substantially co-linear in FIGS. 6B–6D, in other embodiments, first and third openings 82,84 may be offset horizontally from second and fourth openings 86,88 so that hangers 5B, 5D and 5G could hang as designed.

Figure 5G:
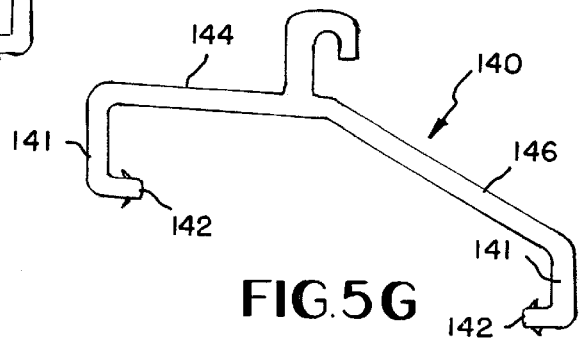
FIG. 5G is a plan view of a sixth embodiment of a hanger.

FIGS. 5A, 5B, 5D, 5F and 5G show alternative embodiments of hangers 90,92, 120, 130 and 140. In the first preferred embodiment of FIG. 5A, the hanger 90 includes a load supporting arm 94 connected at a shoulder 96 to a merchandise supporting arm 98. The merchandise support arm 58 is cantilevered from the shoulder 96. The load supporting arm 94 is connected to a fixture attachment in the form of a hook 100 having a load supporting surface 102 for supporting the weight of the hanger 90, sleeve 70 and merchandise 22 hung thereon. This hanger 90 includes first retention means including first retention arms 104 at a first end 106 of the merchandise support arm 98. The first retention arms 104 are further illustrated in FIGS. 5C and 5E are preferably relatively flexible in order to allow the first end 106 to be directed through the aligned openings 82, 84 and under the merchandise support, such as a fold.

The retention arms 104 are preferably angled and cantilevered relative to an elongated first end 106 of the merchandise support arm 98. The retention arms are angled preferably at less than ninety degrees relative to an axis 105 along the merchandise support arm 98 as illustrated in FIG. 5A, and preferably at less than about forty five degrees as illustrated. Of course, the retention arms 104 may be curved as illustrated in FIG. 5C in a concave manner, or even in a convex manner as the retention arms 117 are illustrated in FIG. 5D. The arms 104,106,110, and 119 also need not necessarily be cantilevered. Arms 119 are angled relative to the support arm 98, but are not cantilevered. Furthermore, retention arms 119 are oppositely angled relative to the supporting arm 98 as opposed to retention arms 110. Also, retention arms 121 are not angled symmetrically about the axis 107. One of the two retention arms 121 is angled about ninety degrees with the other arm angled at about forty five degrees, whereas the retention arms 104 of FIG. 5A are substantially asymmetrical about axis 105.

The various hanger embodiments provide for containing differently configured merchandise products. For instance, in the embodiment of FIG. 5A, the load supporting arm 94 is substantially perpendicular to the shoulder 96. The shoulder is substantially perpendicular to the merchandise support arm 98. This is not the case for the embodiment of FIG. 5B where the load support arm 111 is still parallel to the merchandise support arm 109, but the shoulder 113 is angled at greater than ninety degrees relative to the load support arm 111 and less than ninety degrees relative to the merchandise support arm. This is true for the embodiment of FIG. 5D as well. Instead of providing a horizontal support for the merchandise to rest upon, the embodiments of FIGS. 5B and 5D provide an angled surface relative to a horizontal for supporting merchandise thereon.

Figure 5C:
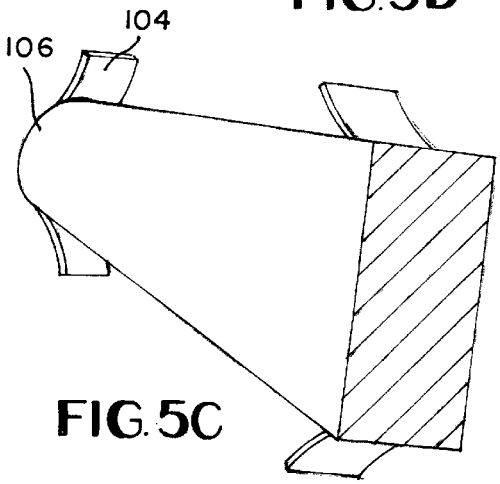
FIG. 5C is a detailed perspective cross section view of the hanger illustrated in FIG. 5A.
Figure 5E:
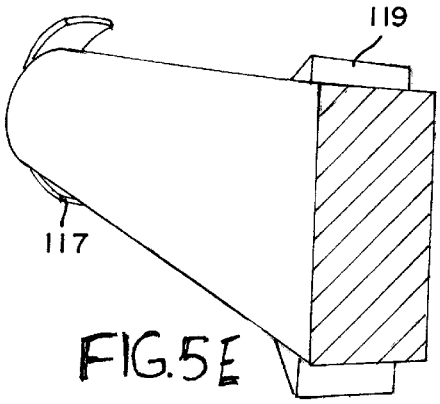
FIG. 5E is a detailed perspective cross section view of the hanger illustrated in FIG. 5D.

FIG. 5B is a second alternative embodiment of a hanger 92. The hanger 92 includes first retention arms 121, however, second retention arms 110 are oppositely angled or oriented relative to the first retention arms 104. This may assist in maintaining the box in a closed configuration in some embodiments. Alternatively, the shoulders 96,113 of either hanger 90,92 may assist in maintaining the sleeve 70 set in a closed configuration.

FIGS. 5F and 5G provide additional embodiments of hangers 130,140. In these hangers, the merchandise support arms 132, 142 do not extend the complete distance between sides of a sleeve as is found in the embodiments of FIGS. 5A,5B,and 5C. Furthermore, instead of having a single load support arm as is found in FIGS. 5A, 5B, and 5C, the embodiments of FIGS. 5F and 5G have two load support arms 134,136 and 144, 146, respectively. In both embodiments of FIGS. 5F and 5G, the merchandise support arms extend substantially horizontally when the hooks 138 and 148 are supported by a peg or the like. Shoulders 131 and 141, respectively, extend substantially perpendicularly to the merchandise support arms 132,142.

In the embodiments of FIGS. 5F and 5G, the shoulders 131, 141 are angled relative to the load support arms 134,136,144,146. In FIG. 5F, the shoulders 131 are angled relative to the load support arms 134,136 at about one hundred ten degrees as illustrated. The load support arms meet at a base 133 which connects to hook 135. The base is substantially parallel to the merchandise support arms 132 and to a horizontal axis 150. Retention arms 137 retain the hanger 130 relative to a sleeve (not shown). The sleeve contains the merchandise 22 at least partially therein.

In FIG. 5G, the shoulders 141 are also angled relative to the load support arms 144,146, but not symmetrically as illustrated in FIG. 5F. Shoulder 141 is angled at about eighty degrees relative to load support arm 144, and shoulder 141 is angled at about one hundred thirty five degrees relative to load support arm 146. Load support arm 146 is also longer than load support arm 144 in this embodiment to space the merchandise support arms 142 at a desired difference in height from one another as illustrated.

Returning back to FIGS. 6A–6D, at the other end of the sleeve 70 are second and fourth openings 86, 88. The second and fourth openings 86, 88 are aligned when the boxes are configured as illustrated in FIGS. 6C and 6D. Accordingly, the first end 106 of the alternatively preferred hanger 90 name is directed through openings 86,88 as well as openings 82,84. The first retention arms 104 are preferably also directed through second and fourth openings 86,88. It is anticipated that the first retention arms 104 will be displaced towards the merchandise support arm 98 such that they may be relatively easily pushed though openings 82,84,86,88 such that the first retention arms 104 preferably do not tear the side panels 78,80,89,91 during application of the hangers 90 through the openings 82,84,86,88 in the sleeve 70. The retention arms 104 preferably spring back to their positions illustrated in FIGS. 5C and 5E after passing through the openings 82,84,86,88. When the retention arms 104 have cleared the third and fourth opening 86,88 it is anticipated that the first retention arms 104 may assist in resisting the hanger 90 from being pulled back through the sleeve 70. Of course if the hangers 130,140 are utilized, the merchandise support arms 132,142 do not extend all the way through the sleeve 70, but only through respective openings 82,84 and 86,88.

Figure 4B:
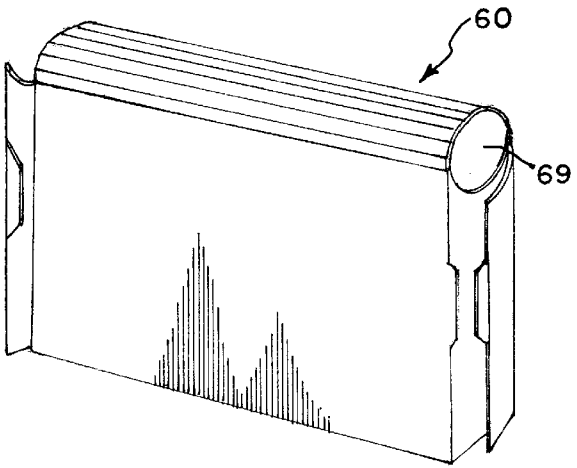
FIG. 4B is a top perspective view of a partially constructed second preferred sleeve.
Figure 4C:
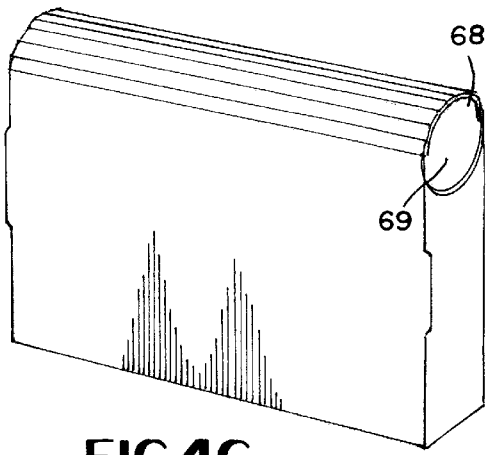
FIG. 4C is a fully constructed sleeve from the blank of FIG. 4A from a top elevational view.
Figure 4D:
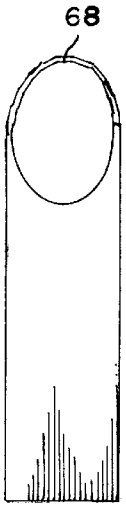
FIG. 4D is a side perspective view of the sleeve of FIG. 4C.
Figure 4A:
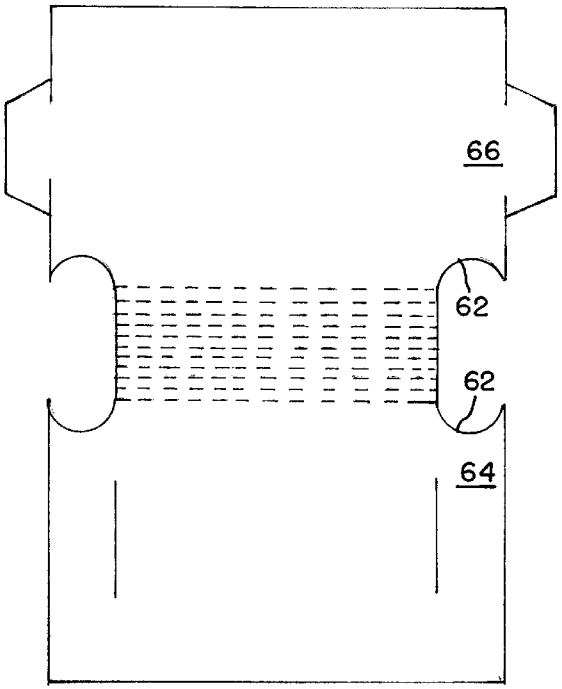
FIG. 4A is a plan view of a sheet blank before being folded into a second preferred sleeve embodiment showing appropriate cuts.

Second retention arms 106 preferably pass through first and second openings 82,84. These second retention arms 106 may assist in maintaining the merchandise on the merchandise support 108 of the merchandise support arm 98 as well as assist in retaining the hanger 90 relative to the sleeve 70. Furthermore, the retention arms 104,106 may also assist in maintaining the sleeve 70 in a closed configuration as illustrated in FIGS. 4C and 4D.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A hanger display package comprising:

an article of merchandise;

a hanger having a merchandise supporting arm and a fixture attachment connected to the merchandise supporting arm;

a sleeve having a front panel, a back panel, a top, and two opposing sides defining a cavity therebetween with a longitudinal length between the two opposing sides, said sleeve further comprising a first opening located below said top; and said merchandise supporting arm extending through said first opening into said cavity, and said article of merchandise supported by said fixture attachment and at least partially contained within the cavity of the sleeve.

2. The hanger display package of claim 1 wherein said merchandise supporting arm extends longitudinally through said first opening.

3. The hanger display package of claim 1 further comprising a second opening located below the top of the sleeve spaced from said first opening, said merchandise supporting arm extending through the first and second opening permitting said article of merchandise to be supported by the merchandise supporting arm within the cavity of the sleeve between the first and second openings.

4. The hanger display package of claim 1 further comprising first and second side panels located respectively at each of the two opposing sides.

5. The hanger display package of claim 4 wherein said first opening is located above a first side panel.

6. The hanger display package of claim 4 wherein said first opening is located in the first side panel.

7. The hanger display package of claim 4 wherein the first side panel is hinged relative to the front panel and extends substantially perpendicularly from the front panel toward the back panel.

8. The hanger display package of claim 7 wherein the second side panel is hinged relative to the front panel and extends substantially perpendicular from the front panel toward the back panel.

9. The hanger display package of claim 7 further comprising a third side panel, said third side panel hinged at a fold relative to the back panel and extending substantially perpendicularly from the back panel to the front panel.

10. The hanger display package of claim 9 further comprising a first slot located along the fold between the third side panel and the back panel, and a first tab connected to the first side panel, said first tab inserted into said slot retaining said first and third side panels substantially adjacent to one another.

11. The hanger display package of claim 6 further comprising a second opening located in the second side panel, and said hanger further comprises first retention means located at a first end of said merchandise supporting arm, and said first retention means extends beyond said second opening to resist said merchandise supporting arm from being pulled back through said second opening.

12. The hanger display package of claim 11 wherein said hanger further comprises second retention means located on a second portion of said merchandise supporting arm.

13. The hanger display of claim 12 wherein said second retention means are located on the cavity said of the first side panel.

14. The hanger display of claim 12 wherein the second retention means are located external to the sleeve.

15. The hanger display of claim 1 wherein the hanger further comprises a load supporting arm connected to the merchandise supporting arm at a shoulder.

16. The hanger display package of claim 1 wherein the fixture attachment of the hanger is a hook.

17. The hanger display package of claim 1 wherein the article of merchandise is supported at a fold in the merchandise by the merchandise supporting arm of the hanger.

18. The hanger display package of claim 1 wherein the top further comprises a top panel having a plurality of longitudinal slits therein.

19. The hanger display package of claim 1 wherein the front blank further comprises an information area.

* * * * *